US008103032B2

(12) United States Patent
Ho et al.

(10) Patent No.: US 8,103,032 B2
(45) Date of Patent: Jan. 24, 2012

(54) HEARING AID

(75) Inventors: Wai Kit David Ho, Singapore (SG); Wee Haw Koo, Singapore (SG); Beng Hai Tan, Singapore (SG)

(73) Assignee: Siemens Medical Instruments Pte Ltd, Singapore (SG)

( * ) Notice: Subject to any disclaimer, the term of this patent is extended or adjusted under 35 U.S.C. 154(b) by 683 days.

(21) Appl. No.: 12/286,675

(22) Filed: Oct. 1, 2008

(65) Prior Publication Data

US 2009/0092270 A1 Apr. 9, 2009

(30) Foreign Application Priority Data

Oct. 4, 2007 (DE) ..... 10 2007 047 335

(51) Int. Cl.
*H04R 25/00* (2006.01)

(52) U.S. Cl. ..... 381/324; 381/322; 381/323; 381/330

(58) Field of Classification Search ..... 381/330, 381/322, 324, 328, 327
See application file for complete search history.

(56) References Cited

U.S. PATENT DOCUMENTS

| | | | | |
|---|---|---|---|---|
| 4,987,597 | A * | 1/1991 | Haertl | 381/325 |
| 6,041,128 | A * | 3/2000 | Narisawa et al. | 381/322 |
| 6,681,022 | B1 * | 1/2004 | Puthuff et al. | 381/338 |
| 6,731,770 | B1 * | 5/2004 | Vonlanthen | 381/330 |
| 6,735,319 | B1 * | 5/2004 | Vonlanthen | 381/330 |
| 7,016,512 | B1 * | 3/2006 | Feeley et al. | 381/324 |
| 7,110,562 | B1 | 9/2006 | Feeley et al. | |
| 7,123,733 | B1 * | 10/2006 | Borowsky et al. | 381/322 |
| 7,267,847 | B2 | 9/2007 | Karamuk | |
| 7,450,732 | B2 * | 11/2008 | Kragelund | 381/323 |
| 2005/0249369 | A1 * | 11/2005 | Angst et al. | 381/322 |
| 2005/0259839 | A1 | 11/2005 | Gabathuler | |

FOREIGN PATENT DOCUMENTS

| | | | |
|---|---|---|---|
| DE | 3723809 | A1 | 1/1989 |
| DE | 19502994 | A1 | 8/1995 |
| DE | 19903090 | A1 | 8/2000 |
| DE | 102004051679 | B3 | 12/2005 |
| EP | 0310866 | A1 | 4/1989 |
| EP | 1432285 | A2 | 6/2004 |
| EP | 1480493 | A1 | 11/2004 |
| WO | 0045617 | A2 | 8/2000 |
| WO | 2004025990 | A1 | 3/2004 |

* cited by examiner

*Primary Examiner* — Steven Loke
*Assistant Examiner* — David Goodwin

(57) ABSTRACT

Hearing aid with a first housing part to accommodate an electrical energy source, a second housing part to accommodate an electronic component and a third housing part to transmit an acoustic stimulus into the ear of a user, wherein the housing parts have a detachable, fluid-tight connection to one another and a facility for selecting an operating state is present in the first or second housing part, having an operating element, which is arranged in a fluid-tight manner on the outside of the housing part.

16 Claims, 2 Drawing Sheets

HEARING AID

CROSS REFERENCE TO RELATED APPLICATIONS

This application claims priority of German application No. 10 2007 047 335.6 DE filed Oct. 4, 2007, which is incorporated by reference herein in its entirety.

FIELD OF INVENTION

The invention relates to a hearing aid with a three-part housing. The first housing part is provided to accommodate an electrical energy source and the second housing part to accommodate an electronic component. The third housing part finally transmits an acoustic stimulus from the hearing aid worn behind the ear into the ear of a user. To prevent the sensitive electronic components being impaired by moisture, all three housing parts are connected to one another by way of a fluid-tight connection.

BACKGROUND OF INVENTION

A hearing aid of the type described in the introduction is known from DE 199 030 90 A1. To prevent the penetration of moisture into the housing to a large extent, said already known hearing aid has no external operating elements. Instead the hearing aid is switched on and off by disassembly or at least detachment of the first housing part with the battery arranged therein. There is no provision for adjustment of the hearing aid to different ambient conditions, for example by changing the amplification.

A battery chamber for a hearing aid that can be closed with a bayonet catch is known from DE 195 02 994 A1. This allows the battery chamber to be closed easily in a water-tight manner, such that even the less dexterous should be able to do this.

Based on this prior art the object of the invention is to specify a hearing aid, which allows adjustment to different operating conditions, in other words different acoustic environments, and at the same time provides substantial protection for the sensitive electronic components against penetrating moisture.

SUMMARY OF INVENTION

According to the invention the object is achieved by a hearing aid with a first housing part to accommodate an electrical energy source, a second housing part to accommodate an electronic component and a third housing part to transmit an acoustic stimulus into the ear of a user, wherein the housing parts have a detachable, fluid-tight connection to one another and a facility for volume control is present in the second or first housing part, having an operating element, which is arranged in a fluid-tight manner on the outside of the housing part.

The inventive hearing aid has a first housing part, which is worn by the user behind the ear together with the second housing part. Fitted in the first housing part is an electrical energy source, for example a lithium polymer battery, a zinc air battery or a capacitor. This supplies an electronic component in the second housing part with electrical energy.

An electronic component within the meaning of this invention can be an electronic amplifier circuit, a noise generator, an A/D or D/A converter or a digital signal processor. These circuits can be discrete or integrated. The precise function of the electronic component is tailored to the needs of the user. The electronic component has at least two different operating states for changing deployment conditions. For example a first operating state can be provided with a first amplification and a second operating state with a second, higher or lower amplification. However it is also possible to change the directional characteristic of a receiver microphone or provide a number of frequency filters, which can be selected by the user.

A selection facility is available for selecting from at least two operating states of the electronic component, having an external operating element. This operating element can be arranged in the first housing part or in the second housing part. In the simplest instance the selection facility is a potentiometer, which controls the amplification of an analog amplifier. To prevent the penetration of moisture by way of the operating element, this is arranged in a fluid-tight manner on the outside of the housing part. For example the axis of a potentiometer can be provided with an O-ring. Alternatively slip ring seals or labyrinth seals are also possible. If the selection facility is a mechanical switch, its operating element can be sealed by means of a bellows. A pressure switch can be operated through an elastic housing part. In this way the water-tightness of the hearing aid is not impaired by the external operating element. But the user has greater operating comfort in that said user can adjust his/her hearing aid to different operating conditions.

The inventive hearing aid also has a third housing part, which conducts an acoustic stimulus into the auditory canal of the user. In the simplest instance this can be a simple tube, which forwards the sound from a sound converter integrated in the second housing part. In another embodiment however a sound converter can also be provided in the auditory canal of the user, being connected by way of the third housing part to the electronic component from the second housing part. Finally where there are a particularly large number of functions, further electronic components can be arranged in the third housing part in addition to the sound converter.

In order to avoid the penetration of moisture, in particular when users are actively engaged in sports, provision is made in one embodiment of the invention to arrange a sound-permeable membrane at the tip of the third housing part. The tip here is the end of the housing part nearest to the auditory canal. Such a membrane can be made of expanded polytetrafluoroethylene for example. This is permeable to sound waves generated in the second or third housing part. The membrane is also permeable to gaseous water vapor. However the penetration of liquid water, cerumen or sweat is reliably prevented. The third housing part therefore also remains clean and dry inside and the useful life and operational reliability of the hearing aid are increased.

The inventive hearing aid can simply generate noise as a tinnitus masker or receive ambient noise by way of a microphone as an amplifier and emit it back into the auditory canal of the user by way of a sound converter. In the last instance a microphone opening is provided in one or more housing parts. In particular a microphone opening is provided in the second housing part. In order also to ensure the water-tightness of the hearing aid, the microphone opening is likewise sealed with a water-tight membrane.

Depending on the electrical energy storage unit used in the first housing part, it may be necessary for air to penetrate into the first housing part. A zinc air battery for example requires a regular air supply to ensure reliable operation. In order to avoid the penetration of moisture with its resulting impairment of the electronic component here too, these openings are likewise provided with a partially permeable membrane, which lets air penetrate and at the same time does not allow the passage of liquid water. This membrane is preferably positioned on the surface defined essentially by the boundary line of the opening. This means that the opening is closed with a tightly stretched membrane, without bags or bulges in the membrane.

If moisture results during operation of the energy storage unit or as additional protection for the electronic component, if water enters the first housing part accidentally, a further water-tight membrane can be provided at the connecting surface between the first and second housing parts. This can likewise be made of expanded polytetrafluoroethylene or, if water vapor permeability is of secondary importance, it can be made of any other material.

To allow simple access to the electronic components, for example for maintenance work, in one embodiment said electronic components are assembled on a frame. The external form of said frame is complementary to the internal form of the second housing part. This means that after completion of the electronic components and their mechanical assembly on the frame, said frame is inserted into the second housing part as a compact module and secured there. It is particularly preferable here for the water-tight membrane for sealing the second housing part also to be arranged on the base surface of the frame facing the first housing part. This means that the housing is closed in a sealed manner even without further assembly work.

BRIEF DESCRIPTION OF THE DRAWINGS

The invention will be described in more detail below without limiting the general inventive compact, with reference to figures, in which.

DETAILED DESCRIPTION OF INVENTION

Figure 1:
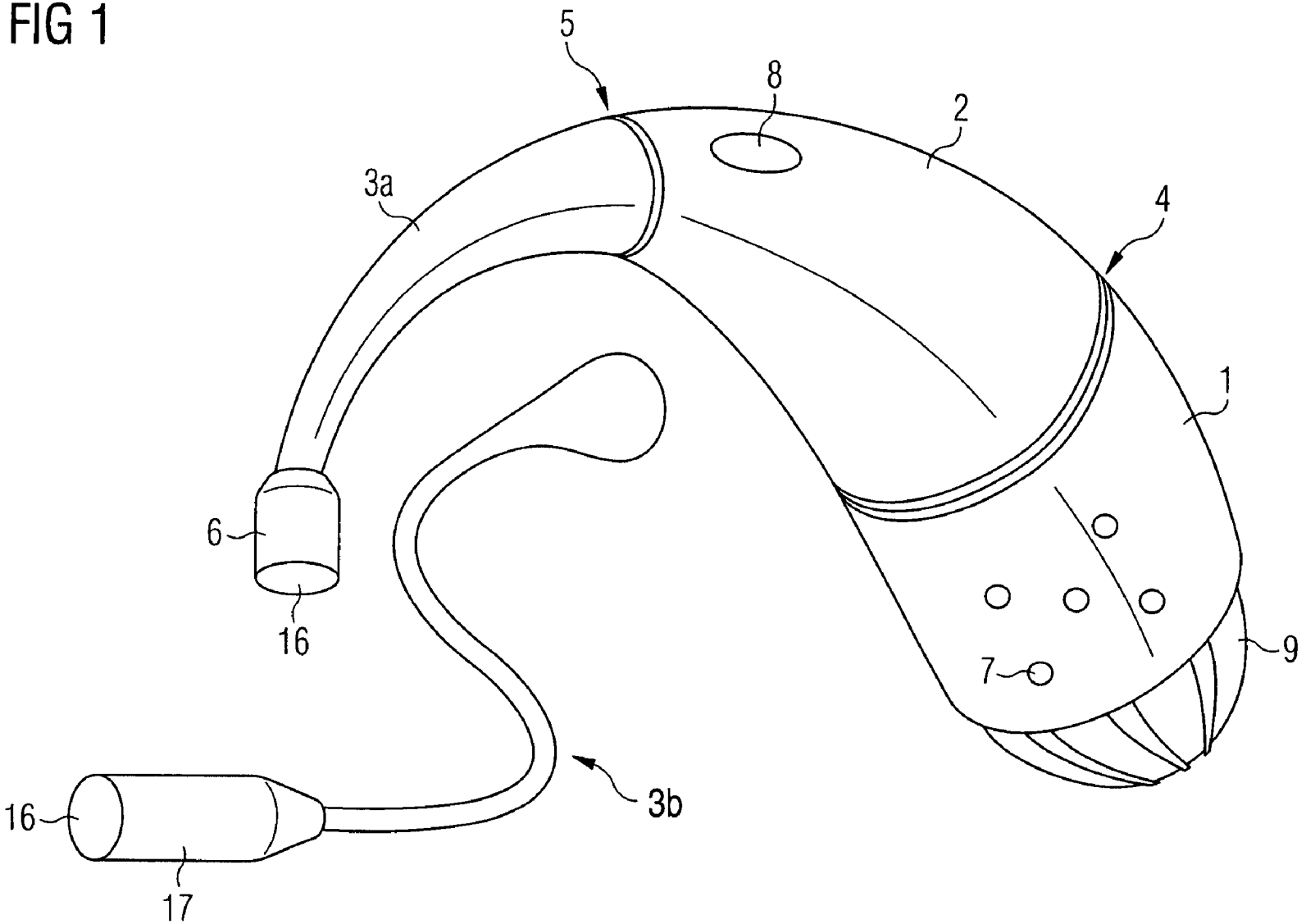
FIG. 1 shows an inventive hearing aid in the assembled state.

The hearing aid according to FIG. 1 has a first housing part 1, a second housing part 2 and a third housing part 3. A threaded joint 4 is located between the first and second housing parts, being configured as fluid-tight by means of an O-ring seal. A threaded joint 5 is likewise located between the second housing part 2 and the third housing part 3*a*, likewise having a seal. Bayonet catches or, if the housing material is elastic, intermateable catches can also be configured instead of the threaded joints 4 and 5. The housing parts themselves are made of a metal or an alloy or a plastic. Depending on the requirements for the plastic, it can be a thermoplastic or a duroplastic. The plastic can be configured so that it is soft and fits snugly to increase wearer comfort or hard to provide better protection for the electronic components inside the hearing aid.

FIG. 1 shows two different embodiments of the third housing part 3*a* and 3*b*. The housing part 3*a* itself contains no active components here. The acoustic stimulus is generated by the electronic components in the housing part 2 and conducted by the housing part 3*a* into the auditory canal of the user. In order to configure the hearing aid so that it is as water-tight as possible for active users and to protect the electronic components from damage in the process, there is a water-tight membrane 16 at the tip 6 of the housing part 3*a*. This prevents the ingress at least of liquid water into the housing part 3*a*. In return the membrane allows sound at least to exit from the housing part 3*a*. The membrane 16 also preferably allows water vapor to exit from the housing part 3*a*.

The housing part 3*b* that can be used as an alternative has a sound converter 17 at its end away from the second housing part. So that this is not damaged by moisture, like the electronic components in housing part 2 and 1, there is also a sound-permeable but water-tight membrane 16 at the opening of the housing part 3*b*. The sound converter 17 is connected by way of connecting lines within the housing part 3*b* to the electronic component in the housing part 2. Since the generated sound is not impaired by resonances in the housing part 3*a*, a better sound quality results when housing part 3*b* is used.

The inventive hearing aid according to FIG. 1 shows a selection facility 9 for selecting a number of operating states of the hearing aid. In the simplest instance the selection facility 9 can be a volume controller. It is however also possible to adjust the hearing aid to varying ambient noise by means of different signal processing programs. A microphone opening 8 is present in the housing part 2, to receive ambient noise, which is further processed and amplified and then emitted by way of the tip 6 or the sound converter 17. In order not to impair water-tightness, this microphone opening is also closed by a sound-permeable and water-tight membrane.

In the exemplary embodiment according to FIG. 1 the hearing aid is operated by a zinc air battery. This requires an adequate exchange of air, in order not to exhibit any capacitance losses. Openings 7 are provided in the housing part 1 for this purpose. So that the openings 7 do not also impair the water-tightness of the housing, they are closed by means of a membrane, which is not permeable to liquid water. However an exchange of air is possible through the openings 7.

Figure 2:
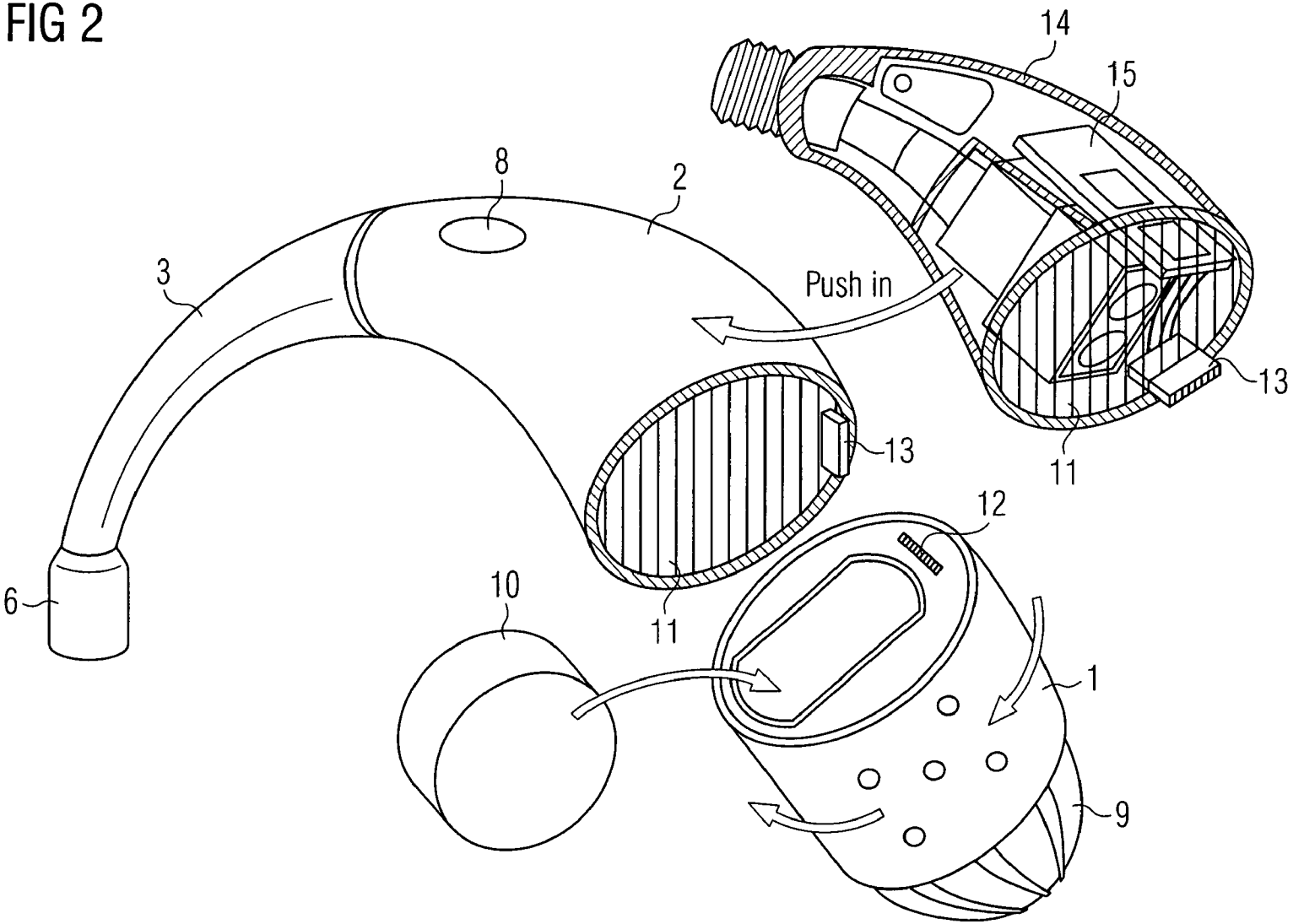
FIG. 2 shows an exploded view of an inventive hearing aid.

FIG. 2 shows an exploded view of the hearing aid according to FIG. 1. Again it shows the 3 housing parts 1, 2 and 3. The screw connection 4 between the first and second housing parts is opened. The battery compartment, into which an essentially cylindrical battery 10 can be inserted, is visible in the first housing part 1. Electrical contacts 12 are also present in the first housing part. When the first housing part is assembled onto the second housing part, the electrical contacts 12 come to rest on the corresponding mating contacts 13 in the second housing part. The contacts 12 serve to bring the electronic component 15 into contact with the battery 10. Further contacts can also be provided, in order also to connect the selection facility 9 to the electronic component. When power is drawn from the battery 10, it can exude moisture. The electronic component 15 is therefore protected from moisture by a membrane 11. The membrane 11 can be permeable to air and/or sound and/or water vapor.

To facilitate assembly the electronic component 15 is located in an assembly frame 14. This has an external form which complements the interior of the second housing part 2. The electronic component 15 in the frame 14 can thus be assembled easily in the housing part 2. Similarly easy disassembly is also possible for maintenance and repair purposes. The water-tight membrane 11 is also preferably located on the assembly frame 14. The electronic component 15 and the membrane 11 are thus assembled in one operation by pushing the assembly frame 14 into the second housing part 2. Either a sound converter, to generate an acoustic stimulus for the user, or an electrical connection, to connect the sound converter in the housing part 3*b* to the electronic component 15, is located at the tip of the assembly frame, in other words between the housing parts 2 and 3 in the assembled state.

We claim:

1. A hearing aid, comprising:

a first housing part that accommodates an electrical energy source;

a second housing part that accommodates an electronic component;

a third housing part that transmits an acoustic stimulus into the ear of a user; and a selection facility to select an operation state, the selection facility having an operating element, the selection facility included in the second or first housing part, the operating element arranged in a fluid-tight manner on the outside of the respective housing part, wherein the housing parts have a detachable, fluid-tight connection to one another such that the first housing part connects to the second housing part and the second housing part connects to the third housing part, and wherein the second housing includes a water-tight membrane at an opening facing the first housing part.

2. The hearing aid as claimed in claim 1, wherein the third housing part has a sound-permeable, water-tight membrane at an end opposite the point of connection to the second housing part.

3. The hearing aid as claimed in claim 2, wherein the membrane of the third housing part comprises polytetrafluoroethylene.

4. The hearing aid as claimed in claim 1, wherein the second housing part has an opening in an outer wall of the respective housing part, the opening having a sound-permeable, water-tight membrane.

5. The hearing aid as claimed in claim 1, wherein the first housing part has an opening in the respective housing part, the opening having an air-permeable, water-tight membrane.

6. The hearing aid as claimed in claim 5, wherein the membrane is located in a surface defined by the boundary line of the opening.

7. The hearing aid as claimed in claim 5, wherein the membrane of the first housing part comprises polytetrafluoroethylene.

8. The hearing aid as claimed in claim 1, wherein the fluid-tight connection between the housing first housing part and the second housing part comprises a screw connection.

9. The hearing aid as claimed in claim 1, wherein the fluid-tight connection between the housing second housing part and the third housing part comprises a screw connection.

10. The hearing aid as claimed in claim 1, wherein fluid-tight connections between the housing parts are provided with an O-ring seal.

11. The hearing aid as claimed in claim 1, further comprising an electrical connector arranged between the first and second housing parts.

12. The hearing aid as claimed in claim 11, wherein the electrical connector has four contacts.

13. The hearing aid as claimed in claim 1, wherein the third housing part encompasses a sound converter.

14. The hearing aid as claimed in claim 11, wherein the electronic component is supported by a frame in the second housing part.

15. The hearing aid as claimed in claim 14, wherein the frame includes a water-tight membrane at an opening facing the first housing part.

16. The hearing aid as claimed in claim 15, wherein the membrane included in the frame comprises polytetrafluoroethylene.

* * * * *